US011408437B2

(12) United States Patent
Nonaka et al.

(10) Patent No.: US 11,408,437 B2
(45) Date of Patent: Aug. 9, 2022

(54) VACUUM PUMP, ROTOR, ROTOR FIN, AND CASING

(71) Applicant: Edwards Japan Limited, Chiba (JP)

(72) Inventors: Manabu Nonaka, Chiba (JP); Toshiki Yamaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 16/757,960

(22) PCT Filed: Oct. 12, 2018

(86) PCT No.: PCT/JP2018/038214
§ 371 (c)(1),
(2) Date: Apr. 21, 2020

(87) PCT Pub. No.: WO2019/082706
PCT Pub. Date: May 2, 2019

(65) Prior Publication Data

US 2020/0340492 A1 Oct. 29, 2020

(30) Foreign Application Priority Data

Oct. 27, 2017 (JP) ..... JP2017-208648

(51) Int. Cl.
*F04D 19/04* (2006.01)
*F04D 29/38* (2006.01)
*F04D 29/54* (2006.01)

(52) U.S. Cl.
CPC ..... *F04D 29/384* (2013.01); *F04D 19/042* (2013.01); *F04D 29/544* (2013.01)

(58) Field of Classification Search
CPC .... F04D 19/042; F04D 29/384; F04D 29/544; F04D 29/701
See application file for complete search history.

(56) References Cited

U.S. PATENT DOCUMENTS 5,059,092 A * 10/1991 Kabelitz ..... F04D 29/058 415/90
5,553,998 A * 9/1996 Muhlhoff ..... F04D 19/046 415/143

(Continued)

FOREIGN PATENT DOCUMENTS

JP H0814188 A 1/1996
JP 2000337290 A 12/2000

(Continued)

OTHER PUBLICATIONS

PCT International Search Report dated Dec. 18, 2019 for corresponding PCT Application No. PCT/JP2018/038214.

(Continued)

*Primary Examiner* — Woody A Lee, Jr.
*Assistant Examiner* — Behnoush Haghighian
(74) *Attorney, Agent, or Firm* — Theodore M. Magee; Westman, Champlin & Koehler, P.A.

(57) ABSTRACT

A vacuum pump includes a rotor that has a rotor central portion and a plurality of stages of rotor blade portions extending from the rotor central portion and having a predetermined elevation angle, and a casing that houses the rotor therein. The rotor further includes a rotor fin. The rotor fin includes a fin shaft portion connected to an end of the rotor central portion, and a transfer blade that extends from the fin shaft portion and causes particles to bounce back in a direction toward an outer periphery of the rotor, the particles falling onto the abovementioned end through an inlet port. The height of the transfer blade and the number of transfer blades are set based on the fall velocity of the particles and the rotation speed of the rotor, such that the particles are prevented from falling onto the abovementioned end without colliding with the transfer blade.

8 Claims, 13 Drawing Sheets

(56) References Cited

U.S. PATENT DOCUMENTS

| | | | | |
|---|---|---|---|---|
| 5,577,883 | A * | 11/1996 | Schutz | F04D 29/584 415/90 |
| 6,755,611 | B1 * | 6/2004 | Kabasawa | F04D 19/042 415/90 |
| 7,828,512 | B2 * | 11/2010 | Eilers | F16C 27/08 415/104 |
| 8,123,412 | B2 * | 2/2012 | Koci | F16C 33/62 384/470 |
| 8,894,355 | B2 * | 11/2014 | Sekita | F04D 29/701 415/121.2 |
| 9,512,848 | B2 * | 12/2016 | Bottomfield | F04D 19/042 |
| 9,512,853 | B2 * | 12/2016 | Bottomfield | F04D 19/042 |
| 2004/0075063 | A1 | 4/2004 | Hasegawa et al. | |
| 2006/0257243 | A1 | 11/2006 | Moriya et al. | |
| 2010/0266426 | A1 * | 10/2010 | Hablanian | F04B 37/06 417/244 |
| 2011/0293401 | A1 * | 12/2011 | Sekita | F04D 19/042 415/90 |
| 2014/0186169 | A1 * | 7/2014 | Bottomfield | F04D 19/042 415/183 |
| 2014/0271174 | A1 * | 9/2014 | Bottomfield | F04D 29/321 415/213.1 |
| 2017/0058902 | A1 * | 3/2017 | Bottomfield | F04D 19/042 |

FOREIGN PATENT DOCUMENTS

| | | | |
|---|---|---|---|
| JP | 2006307823 | A1 | 11/2006 |
| JP | 2010223213 | A1 | 10/2010 |
| TW | 201723317 | A | 7/2017 |
| WO | 2008054164 | A1 | 5/2008 |
| WO | 2008065798 | A1 | 3/2010 |
| WO | 2014152870 | A1 | 9/2014 |

OTHER PUBLICATIONS

PCT International Written Opinion dated Dec. 18, 2019 for corresponding PCT Application No. PCT/JP2018/038214.

European Communication dated Jun. 22, 2021 and Search Report dated Jun. 10, 2021 for corresponding European application Serial No. EP18870503, 11 pages.

* cited by examiner

VACUUM PUMP, ROTOR, ROTOR FIN, AND CASING

CROSS-REFERENCE OF RELATED APPLICATION

This application is a Section 371 National Stage Application of International Application No. PCT/JP2018/038214, filed Oct. 12, 2018, which is incorporated by reference in its entirety and published as WO 2019/082706 A1 on May 2, 2019 and which claims priority of Japanese Application No. 2017-208648, filed Oct. 27, 2017.

BACKGROUND

The present invention relates to a vacuum pump, a rotor, a rotor fin, and a casing.

FIG. 10 is a diagram showing an internal configuration of a conventional vacuum pump. The vacuum pump shown in FIG. 10 is a turbomolecular pump that has a rotor 201 rotated by a motor, wherein gas molecules entering from an inlet port are caused to collide with rotor blades 211 and stator blades 202 of the rotor 201 and transferred toward an outlet port. The rotor blades 211 of this rotor 201 each have a predetermined elevation angle and transfer the colliding gas molecules toward the stator blades 202.

A chamber (such as a chamber of a semiconductor manufacturing apparatus) is connected to the inlet port of such a vacuum pump so gas molecules in the chamber (such as process gas in a semiconductor manufacturing step) are exhausted by this vacuum pump.

In this case, particles 301, such as fine particles of a reaction product generated inside the chamber, may fall onto the rotor 201 of the vacuum pump via the inlet port. When such particles 301 fall onto the rotor blades 211, the particles 301 are exhausted by the rotor blades 211 and the stator blades 202 in accordance with the probability determined by the shapes of these blades. However, when the particles 301 fall onto parts of the rotor 201 other than the rotor blades 211, such as a central portion 212 of the rotor 201, the particles 301 bounce back in a direction opposite to the direction of incidence with respect to the surface that the particles 301 come into contact with. Thus, the particles 301 are highly likely to return to the chamber. This back-flow of the particles 301 affect the processes taking place in the chamber and is therefore not favorable.

In some vacuum pumps, a baffle located at the inlet port of a casing is provided with a disk disposed above a central part of the rotor, to prevent particles from falling onto the central part of the rotor (see Japanese Patent Application Laid-Open No. 2010-223213, for example).

In other vacuum pumps, a cylindrical member is disposed in front of the inlet port, and an annular texture is provided on an inner peripheral surface of the cylindrical member, to capture particles flowing backward from the vacuum pump (see Japanese Patent Application Laid-Open No. 2006-307823, for example).

FIG. 11 is a diagram showing an internal configuration of another conventional vacuum pump. FIGS. 12 and 13 are each a diagram showing an example of a conical member provided in the conventional vacuum pump shown in FIG. 11. In the vacuum pump shown in FIG. 11, in order to improve exhaust efficiency, the conical member is provided above a central part of a rotor 221, the conical member having a conical boss portion 222 and guide blades 223, wherein gas molecules are guided to rotor blades 224 of the rotor 221 by the boss portion 222 and the guide blades 223 (see Japanese Patent Application Laid-Open No. 2000-337290, for example).

The discussion above is merely provided for general background information and is not intended to be used as an aid in determining the scope of the claimed subject matter. The claimed subject matter is not limited to implementations that solve any or all disadvantages noted in the background.

SUMMARY

However, in the vacuum pumps described in Japanese Patent Application Laid-Open No. 2010-223213 and Japanese Patent Application Laid-Open No. 2006-307823, various members that are arranged in the inlet path not only lower the exhaust efficiency of the pumps but also increase the sizes of the pumps.

In the vacuum pump described in Japanese Patent Application Laid-Open No. 2000-337290, as shown in FIGS. 12 and 13, the guide blades are not only large in size but also arranged in large numbers in order to improve the exhaust efficiency, which increases the chance that the particles 301 that bounce off the boss portion 222 or guide blades 223 flows back to the chamber or that particles that bounce off the guide blades 223 are captured by and accumulates at the boss portion 222 or another guide blade 223 and subsequently flows back to the chamber. The vacuum pump of Japanese Patent Application Laid-Open No. 2000-337290, therefore, is not effective enough to curb the bouncing particles, and results in being large in size.

The present invention was contrived in view of the foregoing problems, and an object thereof is to provide a compact vacuum pump capable of preventing the back-flow of particles without impairing the exhaust efficiency, and a rotor, a rotor fin, and a casing that can be used in the vacuum pump.

A vacuum pump according to the present invention includes a rotor that has a rotor central portion and a plurality of stages of rotor blade portions extending from the rotor central portion and having a predetermined elevation angle, and a casing that houses the rotor therein. The rotor further includes a rotor fin. The rotor fin includes a fin shaft portion connected to an end of the rotor central portion, and a transfer blade that extends from the fin shaft portion and causes particles to bounce back in a direction toward an outer periphery of the rotor, the particles falling toward the end through an inlet port. The height of the transfer blade in a rotor axial direction and the number of transfer blades are set based on a fall velocity of the particles and a rotation speed of the rotor, such that the particles are prevented from falling into the end without colliding with the transfer blade.

According to the present invention, a vacuum pump capable of preventing the back-flow of particles without impairing the exhaust efficiency, and a rotor, a rotor fin, and a casing that can be used in such vacuum pump, can be obtained.

The above and other objects, features and advantages of the present invention will become more apparent from the following detailed description in conjunction with the accompanying drawings.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

Embodiments of the present invention are now described hereinafter with reference to the drawings.

Embodiment 1

Figure 1:
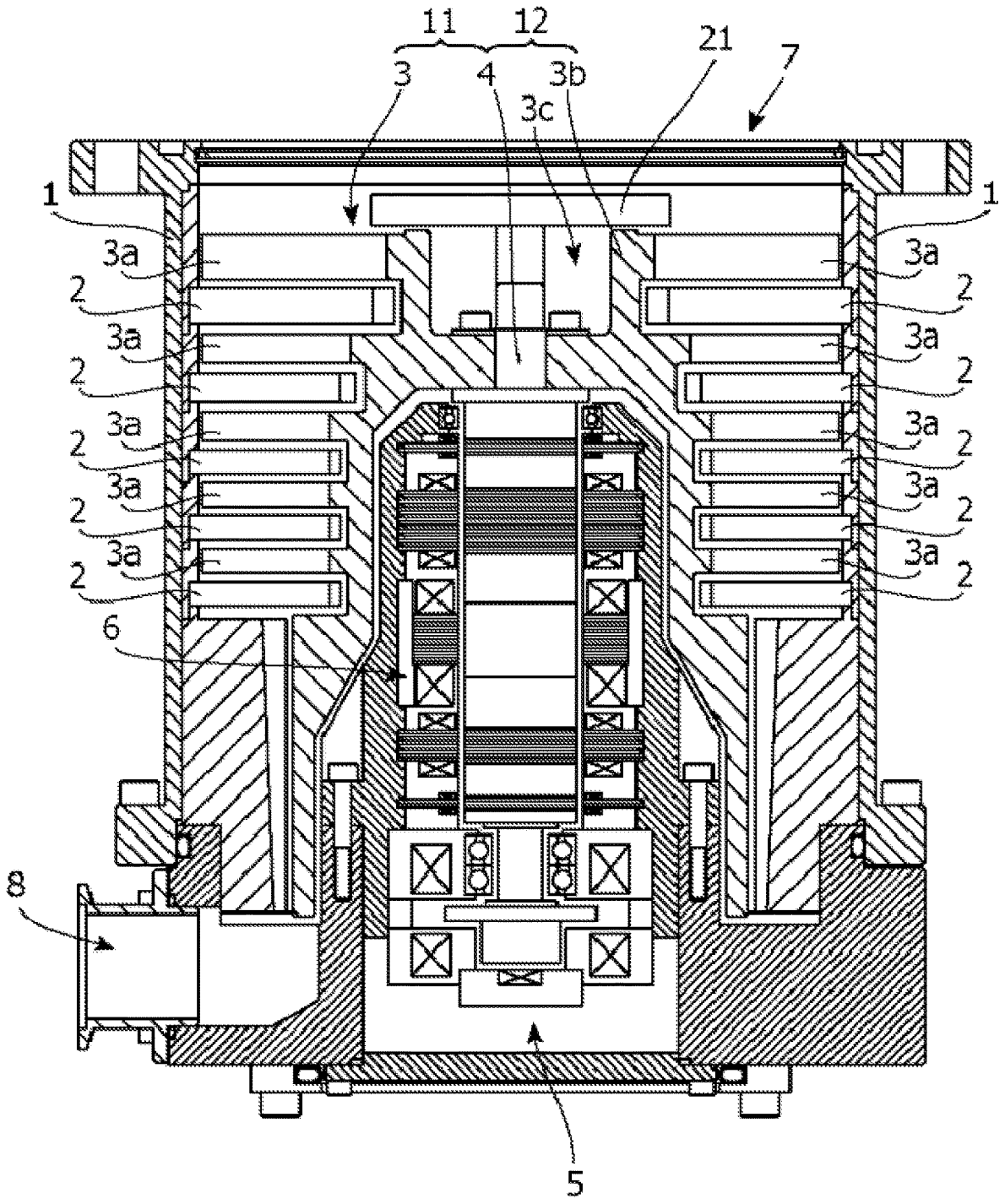
FIG. 1 is a diagram showing an internal configuration of a vacuum pump according to Embodiment 1 of the present invention.

FIG. 1 is a diagram showing an internal configuration of a vacuum pump according to Embodiment 1 of the present invention. The vacuum pump shown in FIG. 1 is a turbomolecular pump and includes a casing 1, stator blades 2, rotor blades 3, a rotor shaft 4, a bearing portion 5, a motor portion 6, an inlet port 7, and an outlet port 8. The rotor blades 3 are fixed to the rotor shaft 4, and a rotor 11 is composed of the rotor blades 3 and the rotor shaft 4.

The casing 1 is in a substantially cylindrical shape, houses the rotor 11, the bearing portion 5, the motor portion 6 and the like in an internal space thereof, and has a plurality of stages of stator blades 2 fixed to an inner peripheral surface thereof. The stator blades 2 are arranged at a predetermined elevation angle.

In the casing 1, a plurality of stages of rotor blade portions 3*a* and the plurality of stages of the stator blades 2 are arranged alternately in a height direction of the rotor shaft (height in a rotor axial direction). The rotor blades 3 have the plurality of stages of rotor blade portions 3*a* and a rotor internal cylinder portion 3*b*. Each of the rotor blade portions 3*a* extends from the rotor internal cylinder portion 3*b* and has a predetermined elevation angle. The rotor internal cylinder portion 3*b* extends, in a radial direction, to an end of the rotor blade portion 3*a* closer to the center of the rotor 11 (the rotor blade portion 3*a* of the first stage). Specifically, the rotor internal cylinder portion 3*b* constitutes part of the rotor blades 3 other than the rotor blade portions 3*a*. A rotor central portion 12 is composed of the rotor shaft 4 and the rotor internal cylinder portion 3*b*. Therefore, the rotor central portion 12 extends, in the radial direction, to the end of the rotor blade portion 3*a* closer to the center of the rotor 11 (the rotor blade portion 3*a* of the first stage). A boss recessed portion 3*c* is formed in the rotor central portion 12, and the rotor shaft 4 and the rotor blades 3 are connected by screws or the like in the boss recessed portion 3*c*.

The bearing portion 5 is a bearing for the rotor shaft 4 and, in this embodiment, is a magnetically levitated bearing. The bearing portion 5 has a sensor for detecting axial and radial displacement of the rotor shaft 4, an electromagnet for suppressing the axial and radial displacement of the rotor shaft 4, and the like. The type of the bearing portion 5 is not limited to the magnetically levitated type. The motor portion 6 electromagnetically rotates the rotor shaft 4.

The inlet port 7 is an opening at an upper end of the casing 1, has a flange shape, and is connected to a chamber or the like, not shown. Due to thermal motion or the like, gas molecules come from the chamber or the like into the inlet port 7. The outlet port 8 has a flange shape and exhausts the gas molecules and the like fed from the rotor blade portions 3*a* and the stator blades 2.

The vacuum pump shown in FIG. 1 is of a composite blade type that has a thread groove pump portion at the stage below a turbomolecular pump portion composed of the stator blades 2 and the rotor blade portions 3*a*, but the vacuum pump shown in FIG. 1 may be of a full blade type.

Figure 2A:
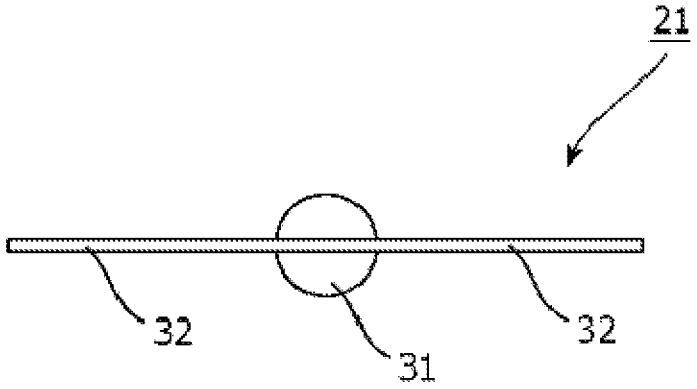
FIGS. 2A and 2B are diagrams showing an example of a rotor fin according to Embodiment 1.
Figure 2:
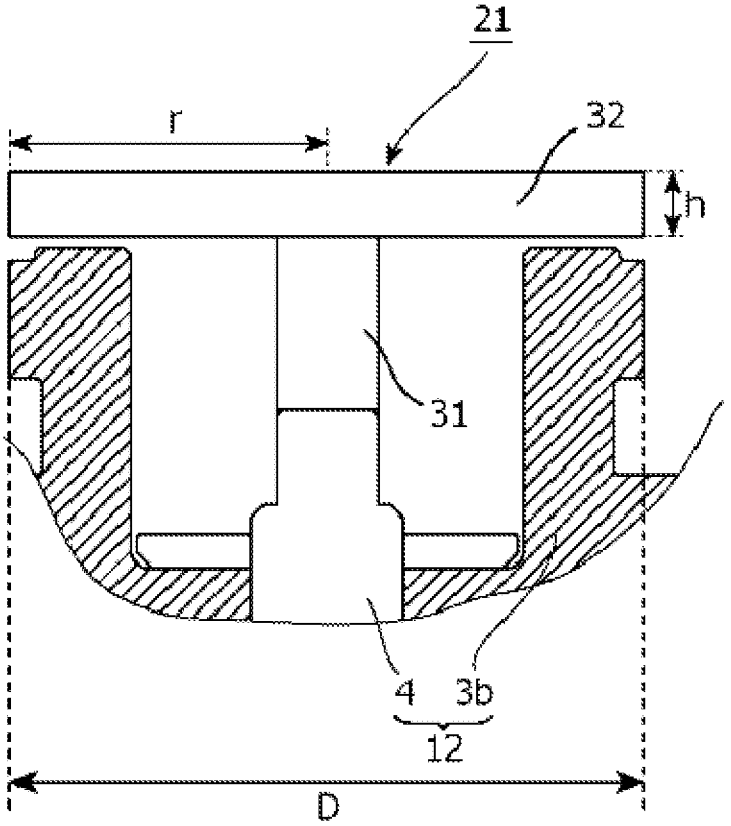

The vacuum pump shown in FIG. 1 further includes a rotor fin 21. FIGS. 2A and 2B are diagrams showing an example of the rotor fin 21 according to Embodiment 1. FIG. 2A is a top view showing an example of the rotor fin 21 according to Embodiment 1. FIG. 2B is a side view showing an example of the rotor fin 21 according to Embodiment 1.

In Embodiment 1, the rotor fin 21 includes a fin shaft portion 31 and transfer blades 32. The fin shaft portion 31 is connected to an end of the rotor central portion 12. The transfer blades 32 extend from the fin shaft portion 31 and cause particles to bounce back in a direction toward an outer periphery of the rotor 11, the particles falling toward the abovementioned end through the inlet port 7. In Embodiment 1, each of the transfer blades 32 is a flat plate standing upright (i.e., parallel to the axial direction) from the fin shaft portion 31 and is a thin flat plate with a small upper surface area. The fin shaft portion 31 and the transfer blades 32 may be configured integrally as a single member or may be configured by connecting a plurality of members.

It is preferred that the transfer blades 32 extend from the center of the rotor fin 21 and have a length r approximately equivalent to the radius of the rotor central portion 12 (D/2) in the radial direction.

The height h of each transfer blade 32 and the number of transfer blades 32 are set based on a fall velocity of the particles and a rotation speed of the rotor 11, such that the particles are prevented from falling onto the end of the rotor central portion 12 without colliding with any of the rotating transfer blades 32.

In Embodiment 1, the number of transfer blades 32 is two, and the height h of each transfer blade 32 is set to be equal to or greater than the distance (height) in which the particles fall in the time required for the rotor 11 to make half rotation (i.e., the reciprocal of the number of transfer blades 32).

The fall velocity of the particles (upper limit) is determined from a drop height specified based on the shape or size (particularly the height) of the chamber connected to the inlet port 7, as well as the arrangement positions of pipes and valves connected to the inlet port 7.

All the transfer blades 32 are arranged such that the particles that bounce off one of the transfer blades 32 do not collide with the other transfer blade 32.

The particles that collide with the transfer blade 32 bounces back, in a horizontal plane, in a direction opposite to the direction of incidence with respect to the surface of the transfer blade 32 where the particles collide. Thus, all the transfer blades 32 may be arranged in such a manner that none of the transfer blades 32 is positioned perpendicular to the surface of a certain transfer blade 32.

In Embodiment 1, the two flat transfer blades 32 are arranged 180 degrees apart, and these two transfer blades 32 are continuous with each other.

The rotor fin 21 is connected to the rotor blades 3 and/or the rotor shaft 4 in the rotor central portion 12. For example, the rotor fin 21 may be connected and fixed to the rotor shaft 4 using a thread mechanism. In so doing, for example, a female screw is formed on either a tip portion of the rotor shaft 4 or the fin shaft portion 31 of the rotor fin 21, and a male screw is formed on the other. In addition, for example, a cylindrical flange may be provided at a lower end of the fin shaft portion 31 of the rotor fin 21, and this flange may be connected and fixed to the rotor blades 3. In so doing, the flange may be fixed to the rotor blades 3 when fixing the rotor blades 3 to the rotor shaft 4 by screws.

Figure 3:
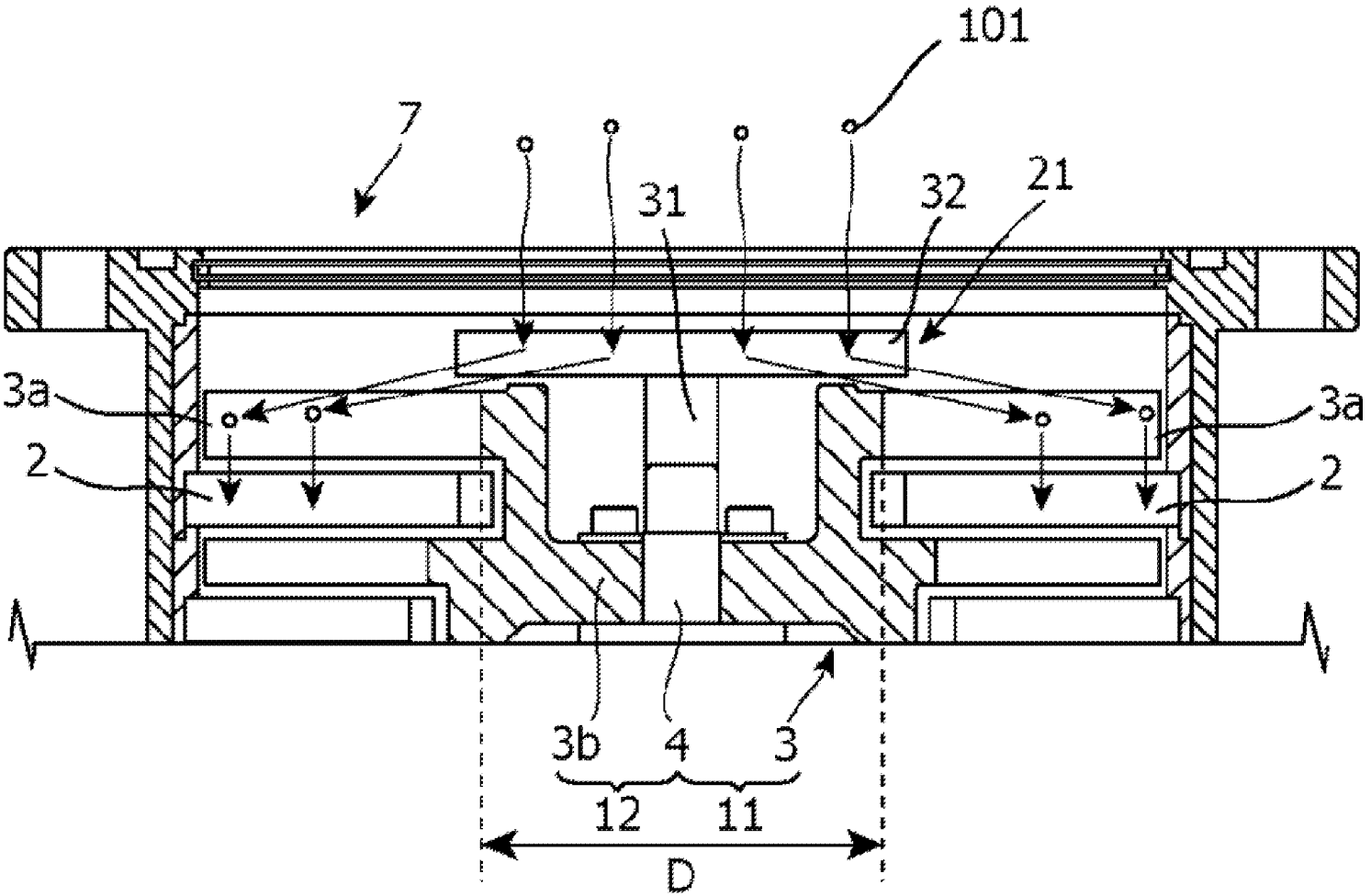
FIG. 3 is a diagram for explaining operations of the vacuum pump according to Embodiment 1.

Operations of the vacuum pump according to Embodiment 1 are described next. FIG. 3 is a diagram for explaining the operations of the vacuum pump according to Embodiment 1.

The chamber or the like is connected to the inlet port 7 of the vacuum pump, and a control device, not shown, is electrically connected to the vacuum pump (such as the motor portion 6). By operating the motor portion 6 with the control device, the rotor shaft 4 rotates, and the rotor blade portions 3*a* rotate as well.

Consequently, the gas molecules coming through the inlet port 7 are exhausted from the outlet port 8 by the rotor blade portions 3*a* and the stator blades 2. Furthermore, in a case where particles 101 fall from the chamber or the like through the inlet port 7 at a position where the rotor blade portions 3*a* pass in the radial direction, the particles 101 collide with the rotor blade portion 3*a* of the first stage, bounce back toward the stator blades 2, and are exhausted from the outlet port 8 by the rotor blade portions 3*a* and the stator blades 2 without flowing back to the chamber or the like.

Also, as the rotor 11 rotates, the rotor fin 21 connected to the rotor 11 rotates as well. Therefore, as shown in FIG. 3, when the particles 101 fall from the chamber or the like through the inlet port 7 toward the rotor central portion 12, the particles 101 collide with the transfer blades 32 of the rotor fin 21 and are given a momentum in the vertical direction with respect to the transfer blades 32. At this moment, the downward momentum caused by the free fall and the momentum in the vertical direction with respect to the transfer blades 32 (the momentum in the horizontal direction) are combined, and thereby the particles 101 bounce back obliquely downward and collide with the rotor blade portions 3*a*. As a result, the particles 101 collide with the rotor blade portion 3*a* of the first stage, bounces back toward the stator blades 2, and is exhausted from the outlet port 8 by the rotor blade portions 3*a* and the stator blades 2 without flowing back to the chamber or the like.

As described above, in the vacuum pump according to Embodiment 1, the rotor 11 includes the rotor central portion 12 and the plurality of stages of rotor blade portions 3*a* extending from the rotor central portion 12 and having a predetermined elevation angle. The rotor 11 further includes the rotor fin 21. The rotor fin 21 includes the fin shaft portion 31 connected to the end of the rotor central portion 12, and the transfer blades 32 that extend from the fin shaft portion 31 and cause the particles 101 to bounce back in the direction toward the outer periphery of the rotor 11, the particles 101 falling toward the abovementioned end through the inlet port 7. The height h of the transfer blades 32 and the number of transfer blades 32 are set based on the fall velocity of the particles 101 and the rotation speed of the rotor 11, such that the particles 101 are prevented from falling onto the abovementioned end without colliding with the transfer blades 32.

The following relational expression is obtained where N represents the rotation speed, vp the fall velocity of the particles, h the height of the transfer blades, and nb the number of transfer blades.

$$h \propto vp \times \frac{1}{nb} \times \frac{1}{N} \quad \text{[Math. 1]}$$

This makes it difficult for the particles 101 to collide with the rotor central portion 12 due to the rotor fin 21. However, since the rotor fin 21 is disposed on the rotor central portion, the rotor fin 21 does not affect the path through which the gas molecules fly from the chamber or the like to the rotor blade portions 3*a*. As a result, the back-flow of the particles 101 is prevented without impairing the exhaust efficiency.

Embodiment 2

Figure 4:
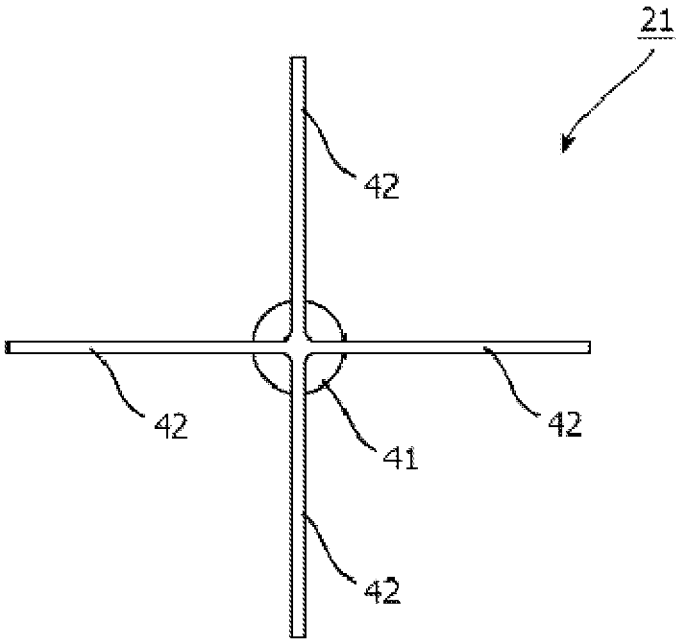
FIGS. 4A and 4B are diagrams showing an example of a rotor fin according to Embodiment 2.
Figure 4:
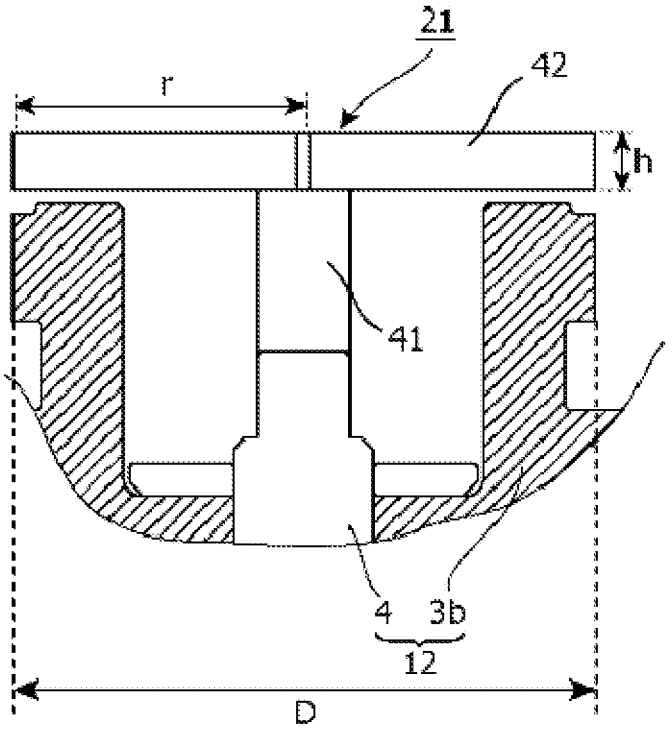

A vacuum pump according to Embodiment 2 has a rotor fin 21 different from that of the vacuum pump according to Embodiment 1. FIGS. 4A and 4B are diagrams showing an example of the rotor fin 21 according to Embodiment 2. FIG. 4A is a top view showing an example of the rotor fin 21 according to Embodiment 2. FIG. 4B is a side view showing an example of the rotor fin 21 according to Embodiment 2.

As shown in FIGS. 4A and 4B, the rotor fin 21 according to Embodiment 2 includes a fin shaft portion 41 similar to the fin shaft portion 31, and four transfer blades 42. The four transfer blades 42 are arranged at equal angular intervals (i.e., 90 degrees), and are the same as the transfer blades 32.

In Embodiment 2, the number of transfer blades 42 is four, and the height h of each transfer blade 42 is set to be equal to or greater than the distance (height) in which particles fall in the time required for the rotor 11 to make quarter turn. Therefore, as long as the fall velocity of the particles is the same as the rotation speed of the rotor 11, the height of the transfer blades 42 only needs to be half the height of the two transfer blades 32 (Embodiment 1).

Other configurations and operations of the vacuum pump according to Embodiment 2 are the same as those described in Embodiment 1; the descriptions thereof are omitted accordingly.

Embodiment 3

A vacuum pump according to Embodiment 3 has a rotor fin 21 different from that of the vacuum pump according to Embodiment 1. FIGS. 5B and 5C are diagrams showing an example of the rotor fin 21 according to Embodiment 3. FIG. 5A is a top view showing an example of the rotor fin 21 according to Embodiment 3. FIGS. 5B and 5C are each a side view showing an example of the rotor fin 21 according to Embodiment 3.

As shown in FIGS. 5A to 5C, the rotor fin 21 according to Embodiment 3 includes a fin shaft portion 51 and two transfer blades 52. The fin shaft portion 51 is connected to an end of the rotor central portion 12 (in this example, an end of the rotor shaft 4). The transfer blades 52 are similar to the transfer blades 32 but have an elevation angle s less than 90 degrees, as shown in FIG. 5C. Therefore, in a case where the elevation angle of the transfer blades 32 is 90 degrees (i.e., as in Embodiment 1), particles colliding with the transfer blades 32 bounce back more downward. This elevation angle s is the angle at which the particles that bounce off the transfer blades 32 do not collide with the rotor central portion 12.

For example, in a case where the radius of the rotor 11 is small and the elevation angle of the transfer blades 32 is 90 degrees, when the particles that bounce off the transfer blades 32 end up colliding with the inner peripheral surface of the casing 1 without colliding with the rotor blade portions 3*a*, the particles that bounce off the transfer blades 32 having the elevation angle s less than 90 degrees are caused to collide with the rotor blade portions 3*a*.

Figure 5:
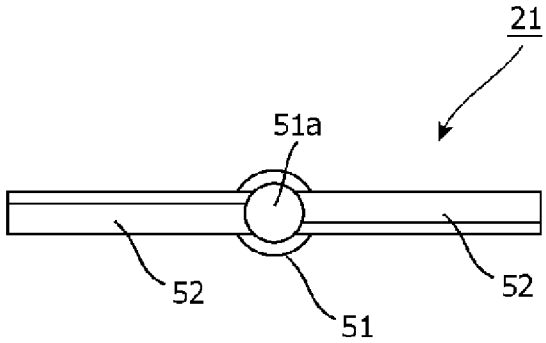
FIGS. 5A to 5C are diagrams showing an example of a rotor fin according to Embodiment 3.
Figure 5:
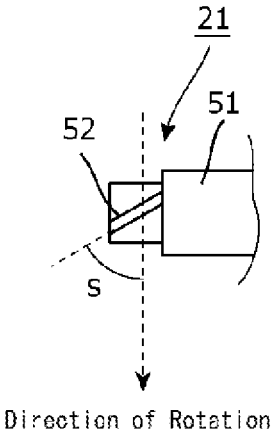
Figure 5:
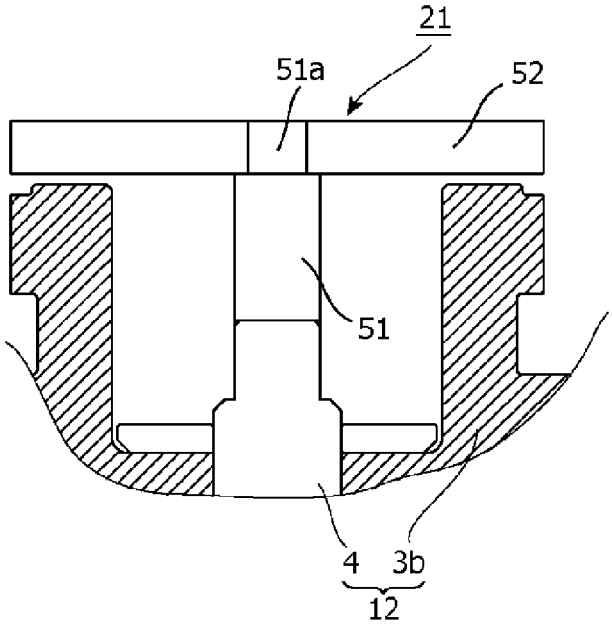

As shown in FIG. 5, in Embodiment 3, the two transfer blades 52 extend vertically from a cylindrical tip portion 51*a* of the fin shaft portion 51; however, the two transfer blades 52 may be continuous to each other at the center without the tip portion 51*a*.

Other configurations and operations of the vacuum pump according to Embodiment 3 are the same as those described in Embodiment 1; the descriptions thereof are omitted accordingly.

Embodiment 4

Figure 6A:
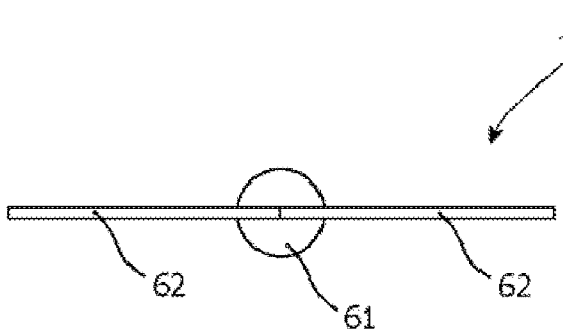
FIGS. 6A to 6C are diagrams showing an example of a rotor fin according to Embodiment 4.
Figure 6:
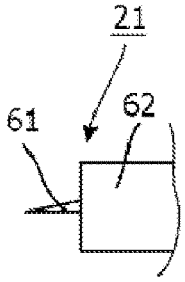
Figure 6B:
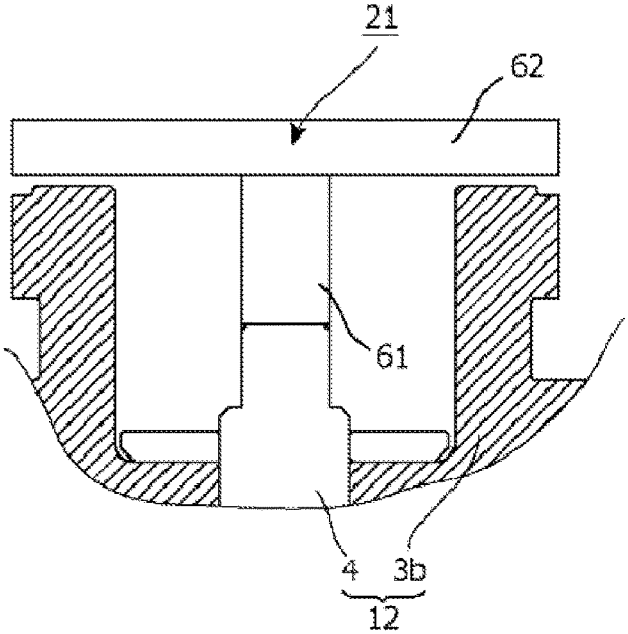

A vacuum pump according to Embodiment 4 has a rotor fin 21 different from that of the vacuum pump according to Embodiment 1. FIGS. 6A to 6C are diagrams showing an example of the rotor fin 21 according to Embodiment 4. FIG. 6A is a top view showing an example of the rotor fin 21 according to Embodiment 4. FIGS. 6B and 6C are each a side view showing an example of the rotor fin 21 according to Embodiment 4.

As shown in FIGS. 6A to 6C, the rotor fin 21 according to Embodiment 4 includes a fin shaft portion 61 similar to the fin shaft portion 31, and transfer blades 62. The transfer blades 62 are similar to the transfer blades 32 but each do not have an upper surface but have one sharp upper edge, as shown in FIG. 6C. Accordingly, particles can be prevented from bouncing off the upper surface of each transfer blade. The entire upper end of each transfer blade 62 may be configured as the abovementioned upper edge, or a part of the upper end of each transfer blade 62 may be configured as the abovementioned upper edge.

Other configurations and operations of the vacuum pump according to Embodiment 4 are the same as those described in Embodiment 1 or 3; the descriptions thereof are omitted accordingly.

Embodiment 5

Figure 7:
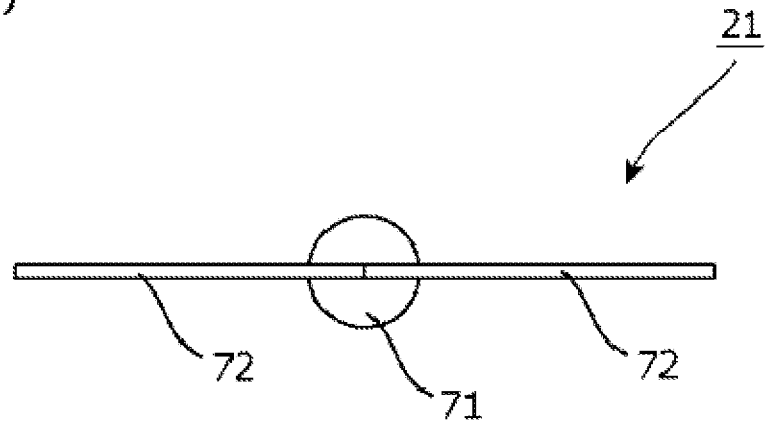
FIGS. 7A and 7B are diagrams showing an example of a rotor fin according to Embodiment 5.
Figure 7:
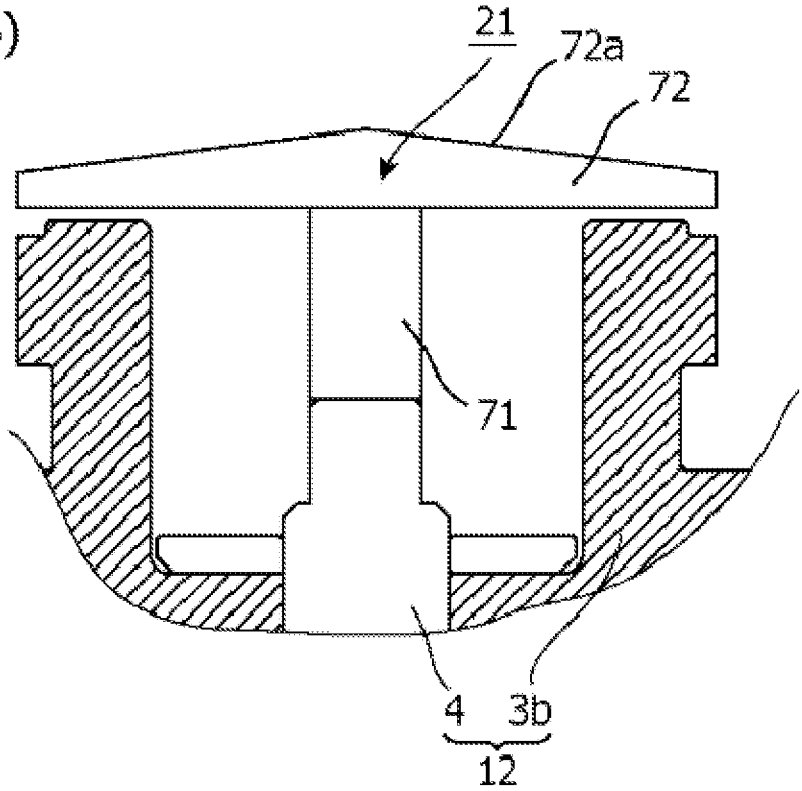

A vacuum pump according to Embodiment 5 has a rotor fin 21 different from that of the vacuum pump according to Embodiment 1. FIGS. 7A and 7B are diagrams showing an example of the rotor fin 21 according to Embodiment 5. FIG. 7A is a top view showing an example of the rotor fin 21 according to Embodiment 5. FIG. 7B is a side view showing an example of the rotor fin 21 according to Embodiment 5.

As shown in FIGS. 7A and 7B, the rotor fin 21 according to Embodiment 5 includes a fin shaft portion 71 same as the fin shaft portion 31, and transfer blades 72. The transfer blades 72 are similar to the transfer blades 32 but each have an inclined upper surface 72*a*, as shown in FIG. 7C. Specifically, in Embodiment 5, the height of the transfer blades 72 becomes gradually small toward the outer periphery of the rotor 11 along the radial direction. Therefore, even if particles bounce off the upper surface 72*a* of each transfer blade 72, the particles collide with the inner peripheral surface of the casing 1 and thereby cannot easily flow back to the chamber or the like. The entire upper surface 72*a* of each transfer blade 72 may be configured as the inclined surface, or a part of the upper surface 72*a* of each transfer blade 72 may be configured as the inclined surface.

Other configurations and operations of the vacuum pump according to Embodiment 5 are the same as those described in any of Embodiments 1, 3 and 4; the descriptions thereof are omitted accordingly.

Embodiment 6

In the vacuum pump according to Embodiment 6, the inner peripheral surface of the casing 1 has, in the height direction, a downward inclined surface at a position lower than the upper end of each transfer blade 32 and higher than the rotor blade portion 3*a* of the first stage. This inclined surface causes the particles 101 that bounce off the transfer blades 32 to bounce off or fall onto the rotor blade portions 3*a*.

Figure 8:
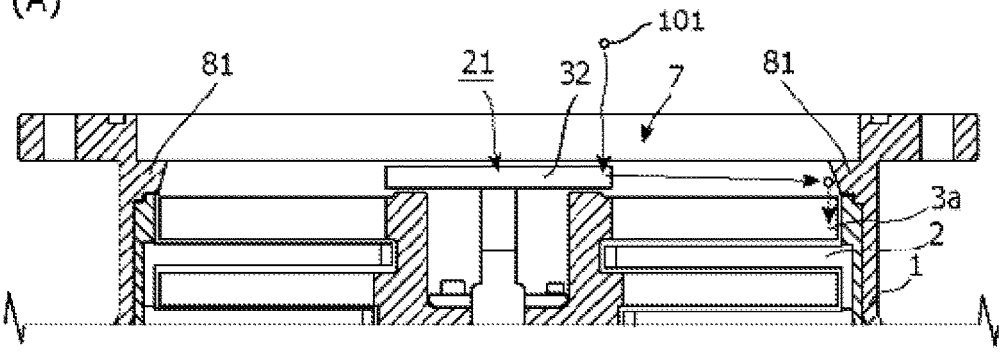
FIGS. 8A to 8C are diagrams showing an example of a casing according to Embodiment 6.
Figure 8:
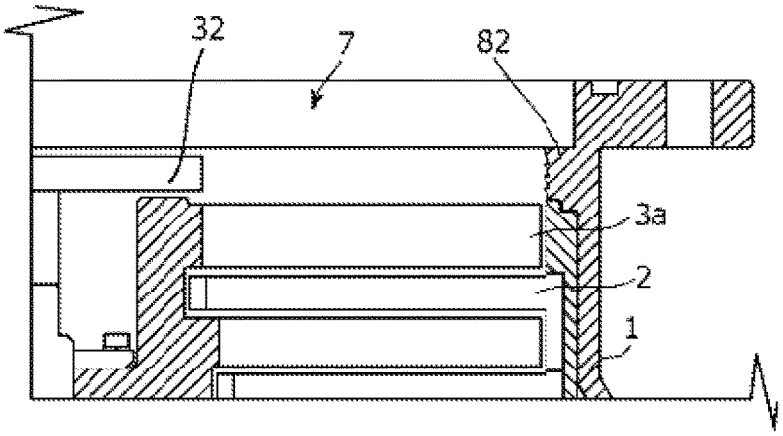
Figure 8:
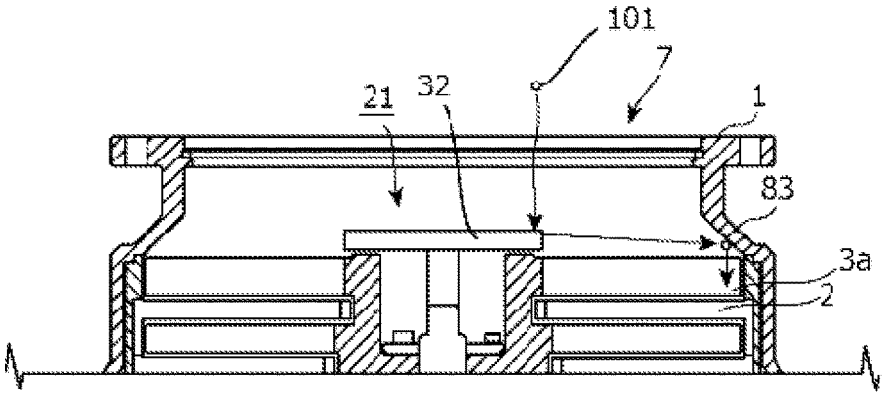

FIGS. 8A and 8B are diagrams showing an example of a casing 1 according to Embodiment 6. FIG. 8A is a cross-sectional view showing the casing 1 in which an annular protruding ridge 81 having an inclined surface at a tip thereof is provided adjacent to the inlet port 7. The inclined surface of the annular protruding ridge 81 is formed in a height range that includes the abovementioned position lower than the upper end of each transfer blade 32 and higher the rotor blade portion 3*a* of the first stage.

FIGS. 8A and 8B are cross-sectional views showing the casing 1 in which an annular protruding ridge 82, a tip of which has a saw-toothed cross section, is provided adjacent to the inlet port 7. A plurality of inclined surfaces on the annular protruding ridge 82 that are continuous in a saw-toothed shape are formed in a height range that includes the abovementioned position lower than the upper end of each transfer blade 32 and higher the rotor blade portion 3*a* of the first stage.

The annular protruding ridges 81, 82 shown in FIGS. 8A and 8B are provided on the inner peripheral surface of the casing in which the radius of the inlet port 7 is the same as the inner peripheral radius of the casing 1 at the height where the rotor blade portion 3*a* is located.

FIG. 8C is a cross-sectional view showing the casing 1 in which the radius of the inlet port 7 is smaller than the inner peripheral radius of the casing 1 at the height where the rotor blade portion 3*a* is located. An inclined surface formed by a tapered portion 83 of the casing 1 is formed in a height range that includes the abovementioned position lower than the upper end of each transfer blade 32 and higher the rotor blade portion 3*a* of the first stage.

Therefore, for example, even in a case where the fall velocity of the particles 101 is low and the particles 101 that bounce off the transfer blades 32 do not directly bounce back to the rotor blade portion 3*a*, the inclined surface described above can cause the particles 101 to bounce back to or fall onto the rotor blade portion 3*a*.

Other configurations and operations of the vacuum pump according to Embodiment 6 are the same as those described in any of Embodiments 1 and 3 to 5; the descriptions thereof are omitted accordingly.

Embodiment 7

Figure 9:
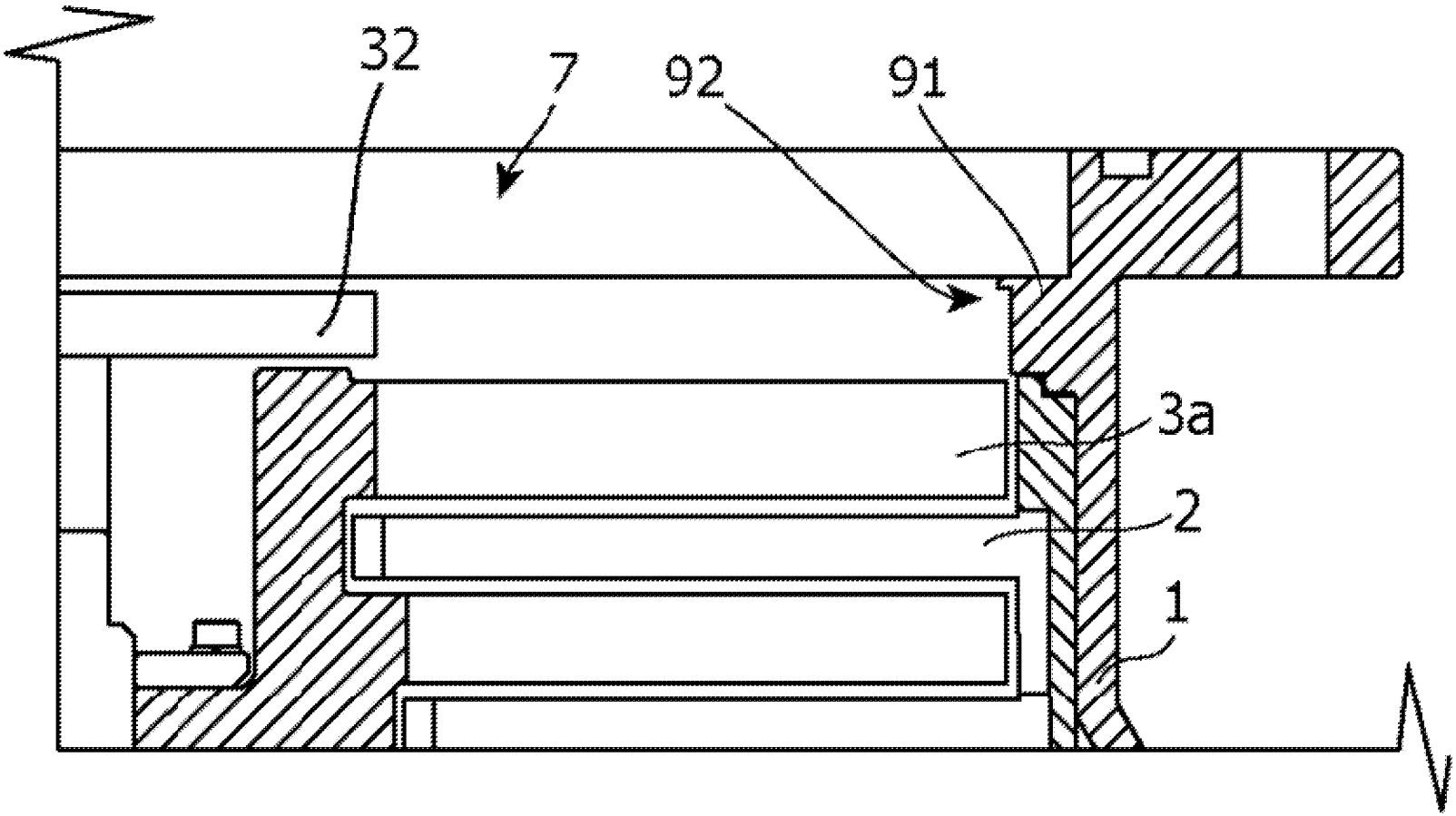
FIG. 9 is a diagram showing an example of a casing according to Embodiment 7.
Figure 10:
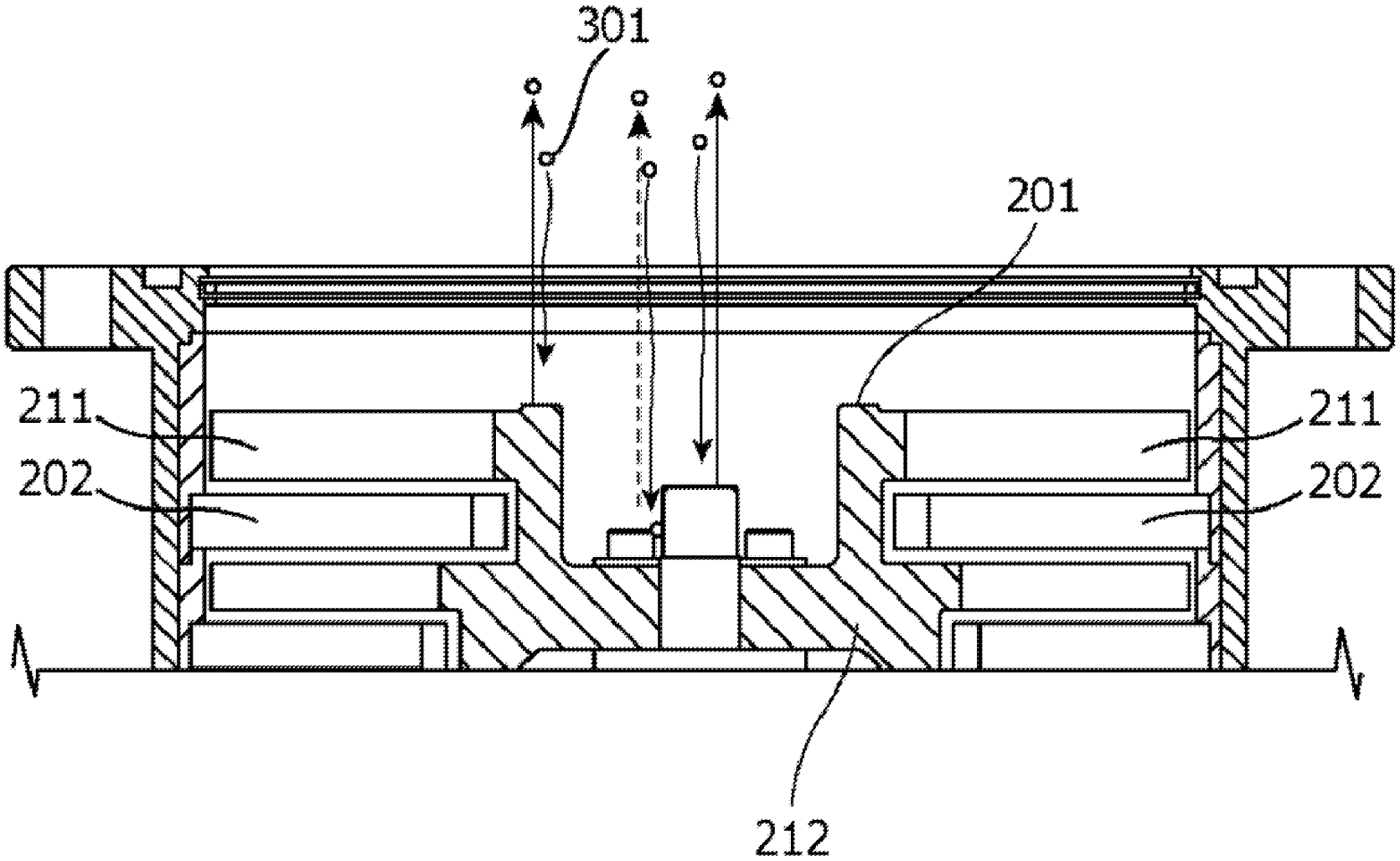
FIG. 10 is a diagram showing an internal configuration of a conventional vacuum pump.
Figure 11:
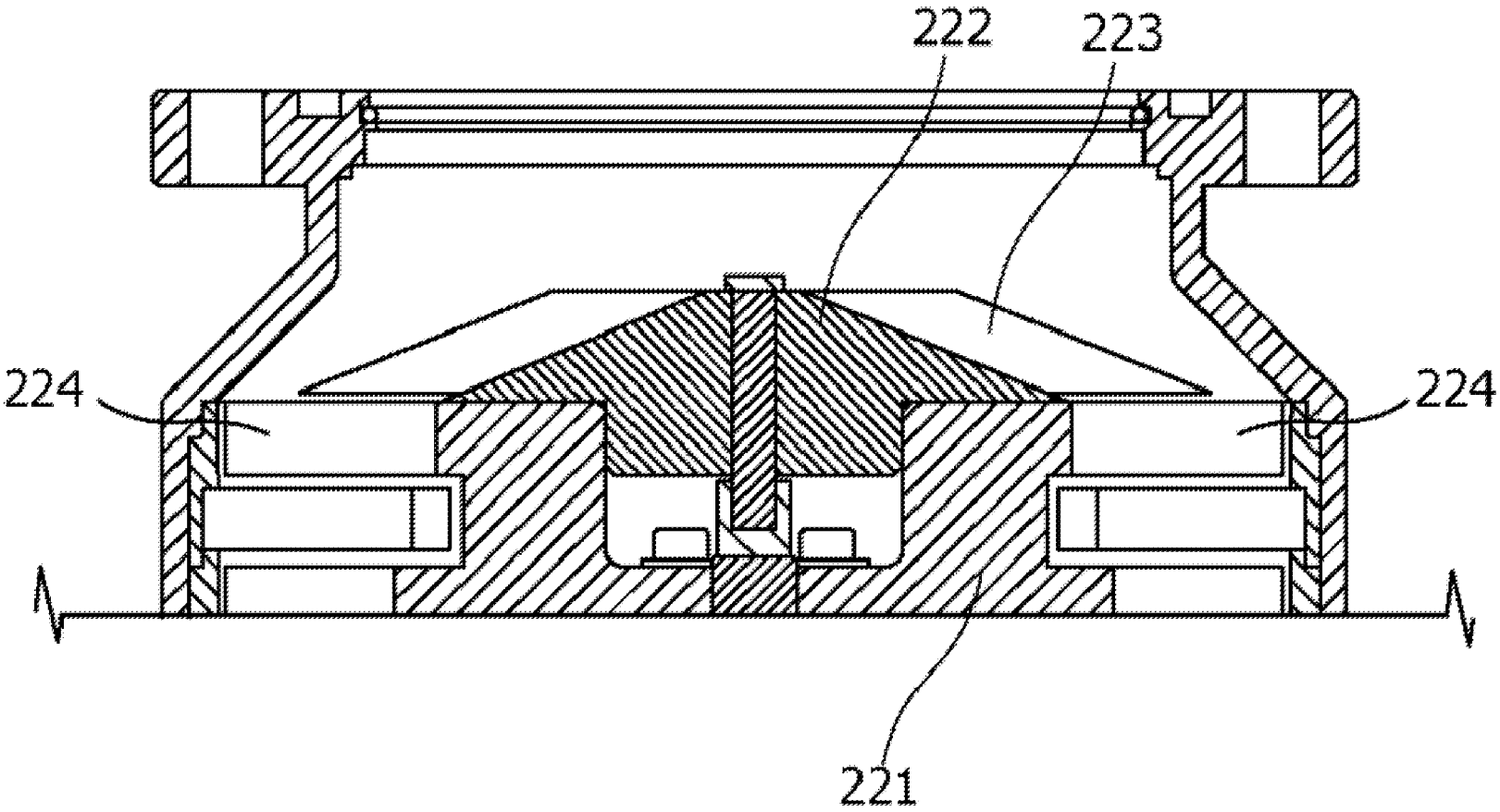
FIG. 11 is a diagram showing an internal configuration of another conventional vacuum pump.
Figure 12:
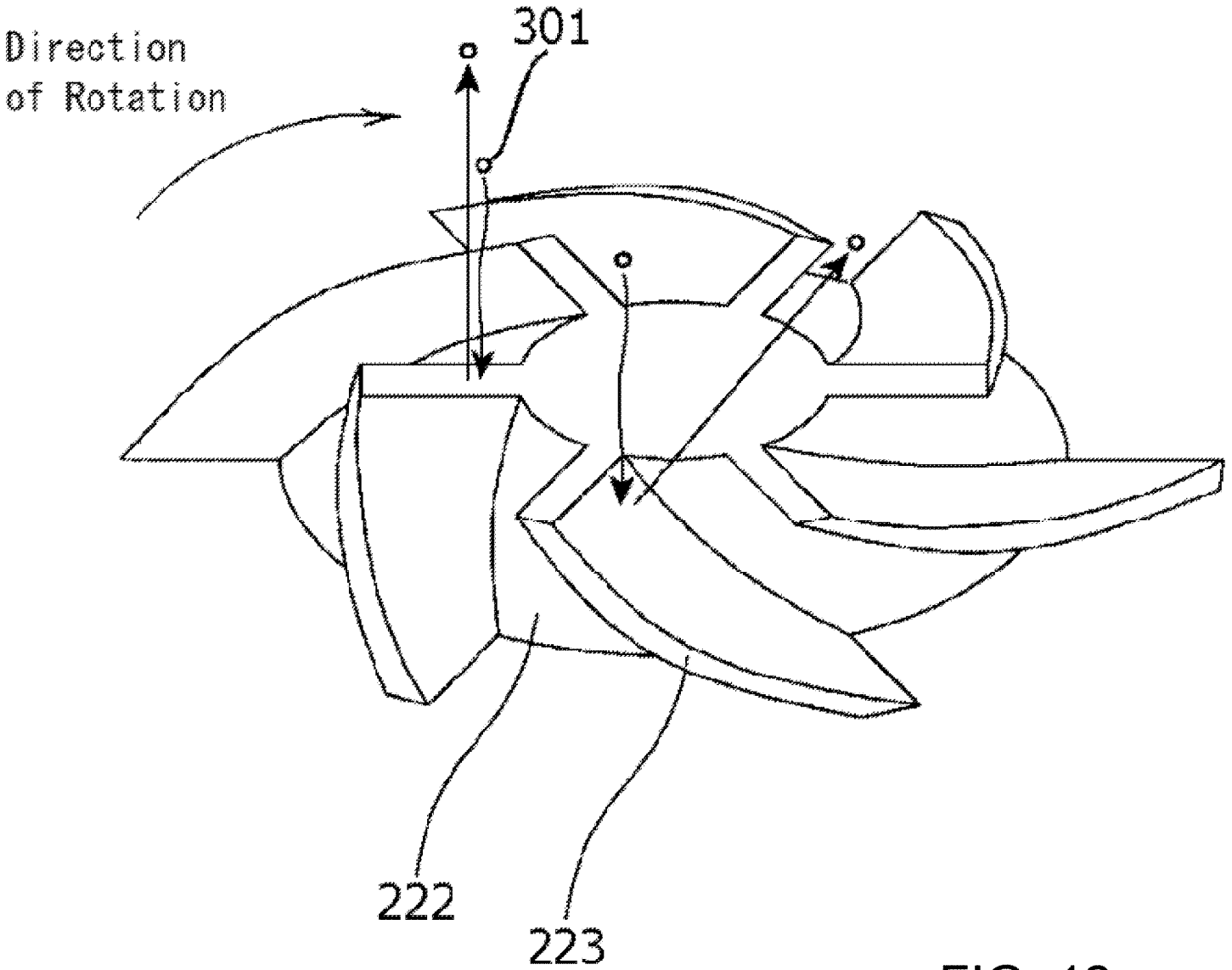
FIG. 12 is a diagram showing an example of a conical member provided in the conventional vacuum pump shown in FIG. 11 (1/2)
Figure 13:
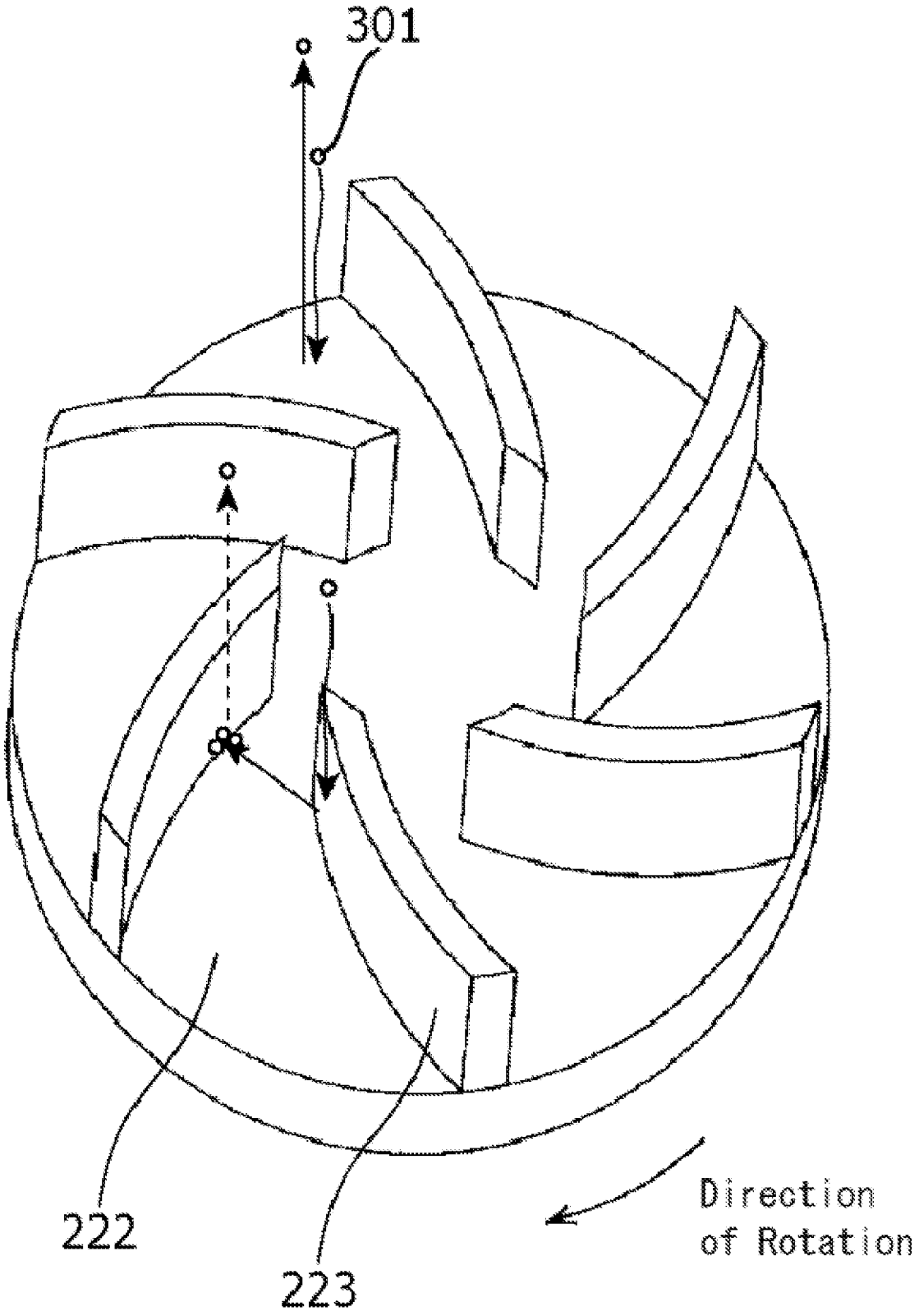
FIG. 13 is a diagram showing an example of the conical member provided in the conventional vacuum pump shown in FIG. 11 (2/2).

FIG. 9 is a diagram showing an example of a casing according to Embodiment 7. In a vacuum pump according to Embodiment 7, on the inner peripheral surface of the casing 1, an annular protruding ridge 91 is provided adjacent to the inlet port 7, and an annular protruding ridge 92 is provided at an upper end portion of the annular protruding ridge 91. Therefore, even in a case where the particles 101 that bounce off the transfer blade 32 collide with the upper surface of the rotor blade portion 3*a* and bounces back in a direction opposite to the stator blades 2, the particles 101 do not easily flow backwards.

Other configurations and operations of the vacuum pump according to Embodiment 7 are the same as those described in any of Embodiments 1 and 3 to 6; the descriptions thereof are omitted accordingly. For example, the annular protruding ridge 92 at the upper end portion may be provided on the annular protruding ridges 81, 82 of Embodiment 6.

changes and modifications to the foregoing embodiments are apparent to those skilled in the art. Such changes and modifications may be made without departing from the spirit and scope of the subject matter and without diminishing the intended advantages thereof. In other words, such changes and modifications are intended to be included in the scope of claims.

For example, in each of the foregoing embodiments, the transfer blade 32, 42, 52, 62, 72 may be a curved plate (i.e., a plate having a curvature in the radius direction). In addition, the transfer blade 32, 42, 52, 62, 72 may be a member (part) composed of a plurality of continuous flat plates bent at a predetermined angle.

Although the number of transfer blades 32 is two in Embodiment 1 and the number of transfer blades 42 is four in Embodiment 2, Embodiments 1 and 2 may each have a different number of transfer blades (such as one or three). Although Embodiments 3 to 7 each have two transfer blades 52, 62, 72, the number of these transfer blades may be different (such as one, three, or four), but the center of gravity of the entire transfer blade is preferably at the center of the rotor fin 21 (the fin shaft portions 31, 41, 51, 61, 71 or an extension thereof).

In each of the foregoing embodiments, a disc-like bottom plate may be provided in the rotor fin 21 in such a manner as to be in contact with a lower end of the transfer blade 32, 42, 52, 62, 72 or in a position lower than the lower end of the transfer blade 32, 42, 52, 62, 72. Accordingly, the boss recessed portion 3*c* is covered by the bottom plate, preventing the process gas or the like from entering the boss recessed portion 3*c*. Thus, for example, corrosion of the screwed parts inside the boss recessed portion 3*c* due to the process gas can be prevented. Even when the bottom plate is provided, the particles 101 collide with the transfer blades 32, 42, 52, 62, 72 but does not reach the bottom plate.

The embodiments of the present invention and each modification thereof may be combined as needed. The present invention is not limited to the embodiments described above, and many modifications can be made by those having ordinary knowledge in the art within the technical concept of the present invention.

The present invention can be applied to, for example, vacuum pumps.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a rotor that includes a rotor central portion and a plurality of stages of rotor blade portions extending from the rotor central portion and having a predetermined elevation angle; and a casing that houses the rotor therein, wherein the rotor further includes a rotor fin, the rotor fin including a fin shaft portion connected to an end of the rotor central portion, and a plurality of transfer blades extending from the fin shaft portion and causing particles falling toward the end through an inlet port to bounce back in a direction toward an outer periphery of the rotor, and a height of the plurality of transfer blades satisfies the following equation 1, $$h \geq vp/(nb \times N) \qquad \text{equation 1}$$

wherein h: the height of the plurality of transfer blades vp: upper limit of fall velocities of the particles nb: number of the plurality of transfer blades N: a rotation speed.

2. The vacuum pump according to claim 1, wherein the plurality of transfer blades are disposed 180 degrees apart.

3. The vacuum pump according to claim 1, wherein the plurality of transfer blades are disposed at an elevation angle less than 90 degrees.

4. The vacuum pump according to claim 1, wherein at least a part of an upper end of the plurality of transfer blades are configured as a sharp upper edge in cross section.

5. The vacuum pump according to claim 1, wherein at least a part of an upper surface of the plurality of transfer blades are inclined along a radius direction.

6. The vacuum pump according to claim 1, wherein an inner peripheral surface of the casing has, in a height direction, an inclined surface at a position lower than the upper end of the plurality of transfer blades and higher than a rotor blade portion of a first stage, the inclined surface causing the particles bouncing off the plurality of transfer blades to bounce back to or fall onto the rotor blade portion.

7. A rotor fin of a rotor of a vacuum pump, the rotor comprising:

a rotor central portion and a plurality of stages of rotor blade portions extending from the rotor central portion and having a predetermined elevation angle, wherein the rotor fin includes a fin shaft portion connected to an end of the rotor central portion, and a plurality of transfer blades extending from the fin shaft portion and causing particles falling onto the end through an inlet port to bounce back in a direction toward an outer periphery of the rotor, and a height of the plurality of transfer blades satisfies the following equation 3, $$h \geq vp/(nb \times N) \quad \text{equation 3}$$

wherein h: the height of the plurality of transfer blades vp: upper limit of fall velocities of the particles nb: number of the plurality of transfer blades N: a rotation speed.

8. A vacuum pump, comprising:

a rotor that includes a rotor central portion and a plurality of stages of rotor blade portions extending from the rotor central portion and having a predetermined elevation angle; and a casing that houses the rotor therein, wherein the rotor further includes a rotor fin, the rotor fin including a fin shaft portion connected to an end of the rotor central portion, and a transfer blade extending from the fin shaft portion and causing particles falling toward the end through an inlet port to bounce back in a direction toward an outer periphery of the rotor, and a height of the plurality of transfer blades satisfies the following equation 2, $$h \geq vp/N \quad \text{equation 2}$$

wherein h: the height of the transfer blade vp: an upper limit of fall velocities of the particles N: a rotation speed.

* * * * *